US011462199B2

(12) United States Patent
Kim et al.

(10) Patent No.: US 11,462,199 B2
(45) Date of Patent: Oct. 4, 2022

(54) HYBRID ACTUATOR AND MULTIMEDIA APPARATUS HAVING THE SAME

(71) Applicant: EM-TECH Co., Ltd, Busan (KR)

(72) Inventors: Cheon Myeong Kim, Gyeongsangnam-do (KR); Sung Chul Jung, Gyeongsangnam-do (KR); Seul Ki Nam, Gyeongsangnam-do (KR)

(73) Assignee: EM-TECH. CO., LTD., Busan (KR)

( * ) Notice: Subject to any disclaimer, the term of this patent is extended or adjusted under 35 U.S.C. 154(b) by 898 days.

(21) Appl. No.: 16/280,945

(22) Filed: Feb. 20, 2019

(65) Prior Publication Data

US 2019/0259362 A1 Aug. 22, 2019

(30) Foreign Application Priority Data

Feb. 21, 2018 (KR) ..... 10-2018-0020429
Jun. 15, 2018 (KR) ..... 10-2018-0068982

(51) Int. Cl.
*G10K 9/122* (2006.01)
*H04R 1/22* (2006.01)
*H04R 9/02* (2006.01)

(52) U.S. Cl.
CPC ..... *G10K 9/122* (2013.01); *H04R 1/22* (2013.01); *H04R 9/025* (2013.01)

(58) Field of Classification Search
CPC ..... G10K 9/122; H04R 1/22; H04R 9/025; H04R 17/00; H04R 2400/03; H04R 2499/15; H04R 11/02; H04R 9/02; H04R 9/06; H04R 2400/11; B06B 1/045
See application file for complete search history.

(56) References Cited

U.S. PATENT DOCUMENTS 5,793,133 A * 8/1998 Shiraki ..... H02K 7/063 310/40 MM
8,129,871 B2 * 3/2012 Huang ..... H04R 31/003 381/326
8,913,767 B2 * 12/2014 Onishi ..... H04R 23/02 381/412
10,154,336 B2 * 12/2018 Tagami ..... H04R 23/02
10,924,866 B2 * 2/2021 Davis ..... H04R 17/005
2005/0185809 A1 * 8/2005 Bianchini ..... H04R 1/24 381/406
2011/0141046 A1 * 6/2011 Sato ..... H01L 41/0973 345/173
2015/0010176 A1 * 1/2015 Schevciw ..... F21S 8/02 381/190
2020/0274412 A1 * 8/2020 Kang ..... H04R 11/02

FOREIGN PATENT DOCUMENTS

CN 201533406 U * 7/2010 ..... H04R 23/02
CN 201533406 U 7/2010
CN 202652283 U 1/2013

(Continued)

*Primary Examiner* — Oyesola C Ojo

(74) *Attorney, Agent, or Firm* — Murphy, Bilak & Homilier, PLLC

(57) ABSTRACT

A hybrid actuator includes a housing for defining an external appearance, a stator having a coil, a vibrator having a permanent magnet which vibrates due to a mutual electromagnetic force with the stator, an elastic member for elastically supporting the vibrator relative to the housing, and a piezoelectric element attached to one surface of the housing.

7 Claims, 6 Drawing Sheets

(56) References Cited

FOREIGN PATENT DOCUMENTS

| | | | | | |
|---|---|---|---|---|---|
| CN | 106954147 | A | | 7/2017 | |
| CN | 206835357 | U | | 1/2018 | |
| CN | 206835357 | U | * | 1/2018 | ..... H04R 9/06 |
| JP | 2004104327 | A | | 4/2004 | |
| JP | 2006121325 | A | | 5/2006 | |
| JP | 2007142920 | A | | 6/2007 | |
| JP | 2007142920 | A | * | 6/2007 | ..... H04R 1/02 |
| KR | 200221515 | Y1 | | 4/2001 | |
| KR | 20020089554 | A | | 11/2002 | |
| KR | 101148055 | B1 | | 5/2012 | |
| KR | 20150016049 | A | | 2/2015 | |
| KR | 101534629 | B1 | | 7/2015 | |
| KR | 101783417 | B1 | | 9/2017 | |
| KR | 1020180003372 | A | | 1/2018 | |

* cited by examiner

HYBRID ACTUATOR AND MULTIMEDIA APPARATUS HAVING THE SAME

TECHNICAL FIELD

The present invention relates to a hybrid actuator, in which a piezoelectric element and an actuator are incorporated with each other, and a multimedia apparatus having the same.

BACKGROUND

A flat panel speaker is used in an apparatus such as a mobile phone, a personal digital assistant (PDA) or a personal computer (PC), and it employs, as a diaphragm, a transparent (flat) panel disposed on the surface of the apparatus to cover a display surface of a display device such as a liquid crystal display device.

FIG. 1 shows an example of a conventional flat panel speaker disclosed in Japan Patent Application Publication 2004-104327, wherein a panel 21 equipped with an actuator 10 is disposed on a surface of a mobile phone, with its edges secured to a case 22 of the mobile phone. Here, a gasket 23 is fitted between the edges of the panel 21 and the case 22 on the whole periphery, and the panel 21 is supported on the case 22 through the gasket 23. In FIG. 1, reference numerals 24 and 25 denote a printed circuit board and a lead wire for connecting the actuator 10 to the printed circuit board 24, respectively. Although not illustrated, for example, a liquid crystal display device is mounted on the printed circuit board 24 as a display device.

In the flat panel speaker with the aforementioned construction, an audio signal is input to the actuator 10, which causes a piezoelectric diaphragm 11 and 12 to vibrate, such vibration is transferred to the panel 21 through a holder 13 in the form of waves, and sound is emitted through the entire panel 21. The gasket 23 fitted between the panel 21 and the case 22 serves to decrease the vibration transferred to the case 22 and increase the amount of vibration of the panel 21.

However, the piezoelectric diaphragm sufficiently generates mid- and high-frequency sounds, but is not suitable for generating a low-frequency sound. Moreover, a piezoelectric element can generate a vibration force enough to generate a sound, but cannot provide a vibration force strong enough to allow a vibration function.

SUMMARY

An object of the present invention is to provide a hybrid actuator, in which a piezoelectric element generates mid- and high-frequency sounds and a linear actuator generates a low-frequency sound and a vibration signal, and a multimedia apparatus having the same.

According to an aspect of the present invention for achieving the above object, there is provided a hybrid actuator, including: a housing for defining the external appearance, a stator having a coil, a vibrator having a permanent magnet which vibrates due to a mutual electromagnetic force with the stator, an elastic member for elastically supporting the vibrator relative to the housing, and a piezoelectric element attached to one surface of the housing.

In some embodiments, the vibrator may reproduce low- and mid-frequency sounds and the piezoelectric element may reproduce mid- and high-frequency sounds.

In some embodiments, the vibrator may vibrate at a frequency of 50 to 300 Hz to generate a sensible vibration signal and may vibrate at a frequency of 50 to 5000 Hz to generate a low-frequency sound signal, and the piezoelectric element may vibrate at a frequency of 300 to 20000 Hz.

In some embodiments, the elastic member may be arranged between one surface of the housing and the vibrator, and the piezoelectric element may be arranged on the surface of the housing on which the elastic member is not arranged.

In some embodiments, the piezoelectric element may be arranged on the inner surface of the housing.

In some embodiments, the piezoelectric element may be arranged on the outer surface of the housing.

In some embodiments, two or more terminals may be provided to transfer a signal from the outside to the hybrid actuator.

According to another aspect of the present invention for achieving the above object, there is provided a multimedia apparatus having a hybrid actuator described above, the multimedia apparatus including a display panel and a frame, wherein the hybrid actuator is coupled to the display panel or the frame to vibrate the whole multimedia apparatus to generate sound.

In some embodiments, the hybrid actuator may be configured such that the surface on which the piezoelectric element is arranged is brought into contact with the display panel or the frame.

In some embodiments, the hybrid actuator may be configured such that the surface on which the piezoelectric element is not arranged is brought into contact with the display panel or the frame.

In the hybrid actuator and the multimedia apparatus having the same according to the present invention, as the linear actuator and the piezoelectric element are incorporated with each other, the linear actuator serves to generate a low-frequency sound and a sensible vibration and the piezoelectric element serves to generate mid- and high-frequency sounds, which makes it possible to overcome disadvantages of the conventional panel speaker using the piezoelectric element.

In addition, the hybrid actuator according to the present invention does not have to include a vibration module and a piezoelectric element separately, which is advantageous in terms of space.

Those skilled in the art will recognize additional features and advantages upon reading the following detailed description, and upon viewing the accompanying drawings.

DETAILED DESCRIPTION

Hereinafter, preferred embodiments of a hybrid actuator and a multimedia apparatus having the same according to the present invention will be described in detail with reference to the accompanying drawings.

Figure 1:
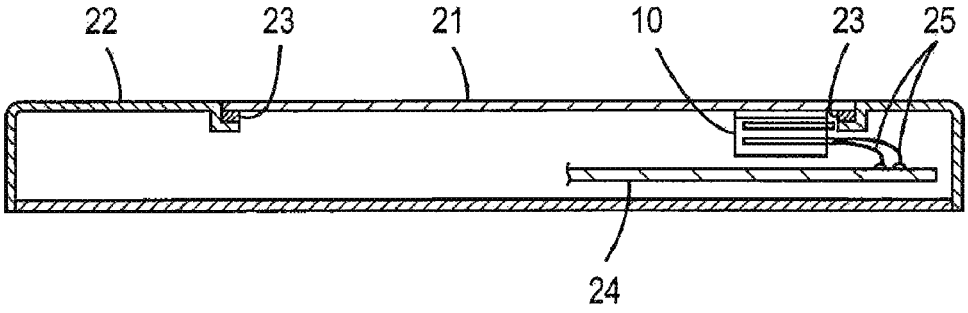
FIG. 1 is a view showing one example of a conventional flat panel speaker having a piezoelectric element.
Figure 2:
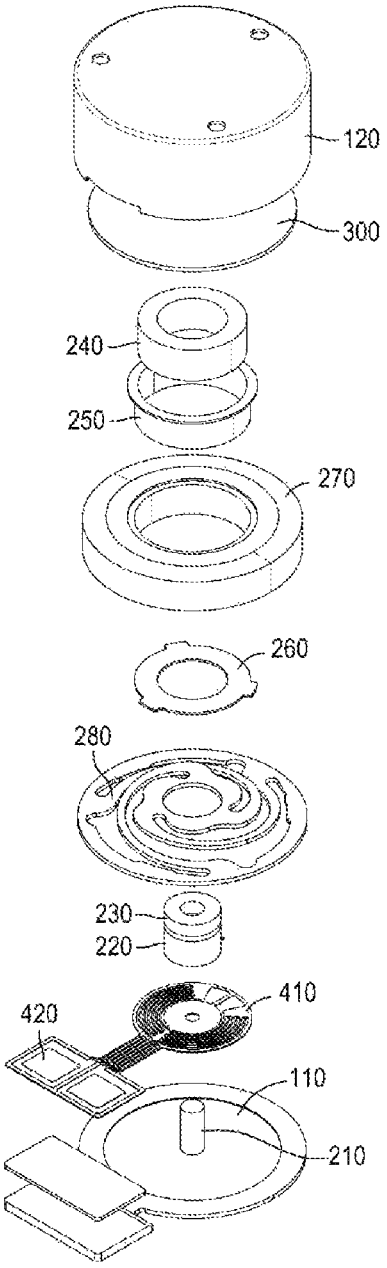
FIG. 2 is an exploded view showing a hybrid actuator according to a first embodiment of the present invention.
Figure 3:
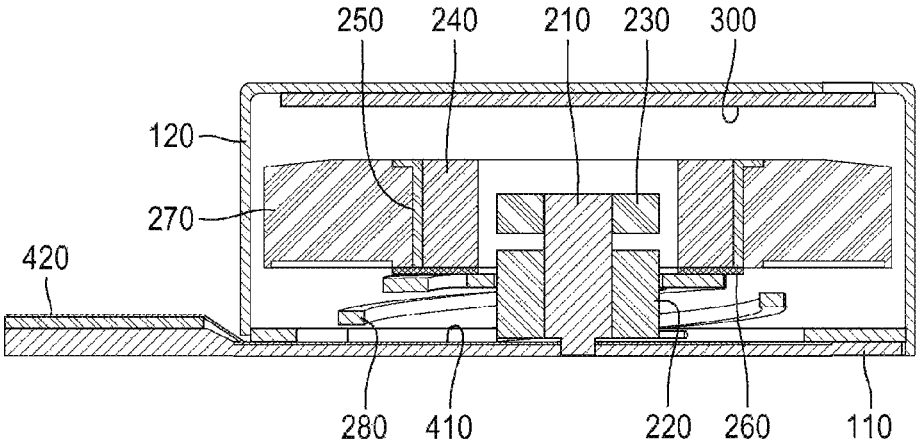
FIG. 3 is a sectional view showing the hybrid actuator according to the first embodiment of the present invention.

FIG. 2 is an exploded view showing a hybrid actuator according to a first embodiment of the present invention, and FIG. 3 is a sectional view showing the hybrid actuator according to the first embodiment of the present invention.

In the hybrid actuator according to the first embodiment of the present invention, components are arranged in a housing formed by coupling a lower housing 110 defining a bottom surface and an upper housing 120 defining top and side surfaces. A pole piece 210, a coil 220 and a top plate 230, which form a stator, are disposed on the bottom surface of the lower housing 110, the coil and the top plate being coupled around the pole piece 210.

A vibrator is disposed on the same axis as that of the stator 210, 220 and 230 to vertically vibrate due to a mutual electromagnetic force. The vibrator includes a permanent magnet 240 formed in a ring shape and disposed with an air gap from the stator 210, 220 and 230, a yoke 250 coupled around the permanent magnet 240, a top plate 260 attached to the bottom surface of the permanent magnet 240, and a weight 270 coupled to the outside of the yoke 250 to enhance a vibration force of the vibrator. In addition, an elastic member 280 for elastically supporting the vibrator may be interposed between the vibrator and the lower housing 110.

In the first embodiment of the present invention, the housing 110 and 120, the vibrator and the stator are all formed in a circular shape, such that the elastic member 280 is also formed in a circular shape, with the outer periphery secured to the lower housing 110 and the center secured to the vibrator. However, it is to be noted that the housing, the vibrator and the stator may be formed in a quadrangular shape, in which case there may be two or more elastic members and the shape of the elastic member may vary.

Figure 4:
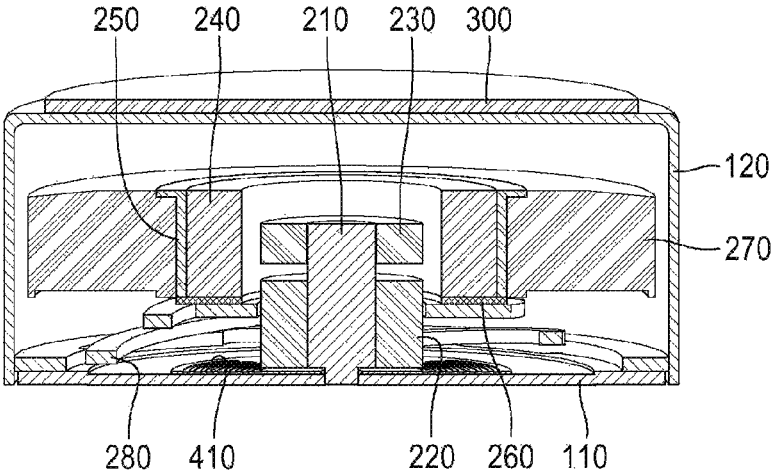
FIG. 4 is a sectional view showing a hybrid actuator according to a second embodiment of the present invention.

Meanwhile, a piezoelectric element 300 is attached to the top surface of the upper housing 120 not to overlap with the surface on which the elastic member 280 is arranged. The piezoelectric element 300 is attached to the inner surface of the upper housing 120 in the first embodiment of the present invention, but may be attached to the outer surface of the upper housing 120, as in a second embodiment of the present invention shown in FIG. 4.

The vibrator can vibrate at a frequency of 50 to 5000 Hz, which leads to the vibration of the whole multimedia apparatus having the hybrid actuator (see FIGS. 9 to 11), which generates a low-frequency sound. In addition, the piezoelectric element can vibrate at a frequency of 300 to 20000 Hz, which leads to the vibration of the whole multimedia apparatus having the hybrid actuator, which generates mid- and high-frequency sounds. Further, the vibrator can vibrate the whole multimedia apparatus to generate a low-frequency sound, while vibrating at a frequency of 50 to 300 Hz to generate a sensible vibration that can be sensed by a user.

Furthermore, a PCB 410 that can transfer an electric signal to the coil 220 and the piezoelectric element 300 may be further provided on the inside of the lower housing 110. The PCB 410 is electrically connected to a terminal 420 extended to the outside of the housing 110 and 120.

In the first embodiment of the present invention, the coil serves as the stator and the permanent magnet serves as the vibrator, but it is also possible that the coil serves as the vibrator and the permanent magnet serves as the stator.

Figure 5:
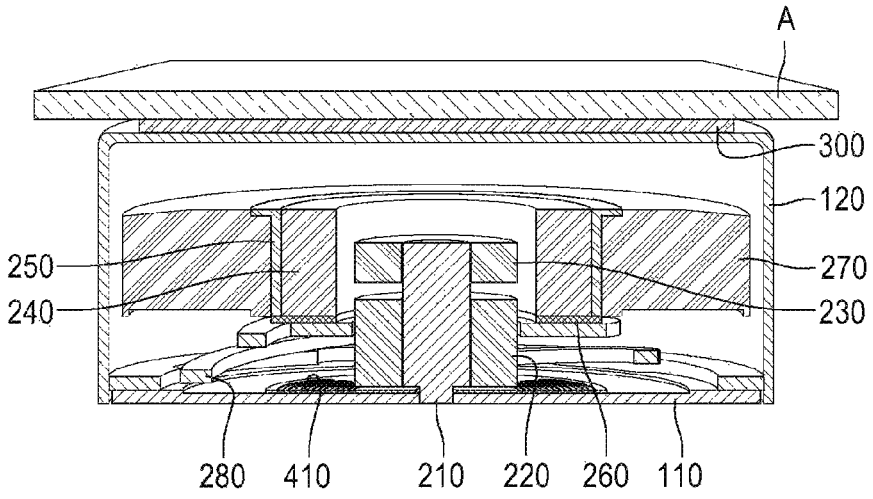
FIG. 5 is a view showing one example of a method of installing the hybrid actuator according to the second embodiment of the present invention.

FIG. 5 is a view showing one example of a method of installing the hybrid actuator according to the second embodiment of the present invention. When the hybrid actuator is attached to a portion A of the multimedia apparatus, the surface to which the piezoelectric element 300 is attached, i.e., the top surface of the upper housing 120 may be brought into contact with the portion A of the multimedia apparatus. On the contrary, as shown in FIG. 6, the surface to which the piezoelectric element 300 is not attached, i.e., the bottom surface of the lower housing 110 may be brought into contact with the portion A of the multimedia apparatus.

Figure 6:
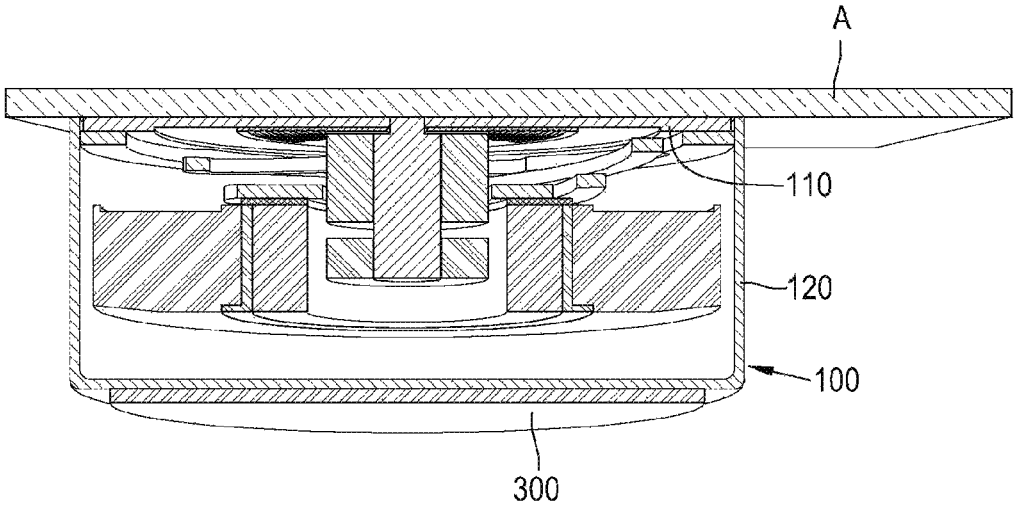
FIG. 6 is a view showing another example of the method of installing the hybrid actuator according to the second embodiment of the present invention.

FIGS. 5 and 6 show the method of installing the hybrid actuator according to the second embodiment of the present invention. However, also in the case of the first embodiment in which the piezoelectric element 300 is attached to the inner surface of the upper housing 120, the top surface of the upper housing 120 or the bottom surface of the lower housing 110 may be brought into contact with the portion A of the multimedia apparatus.

Figure 7:
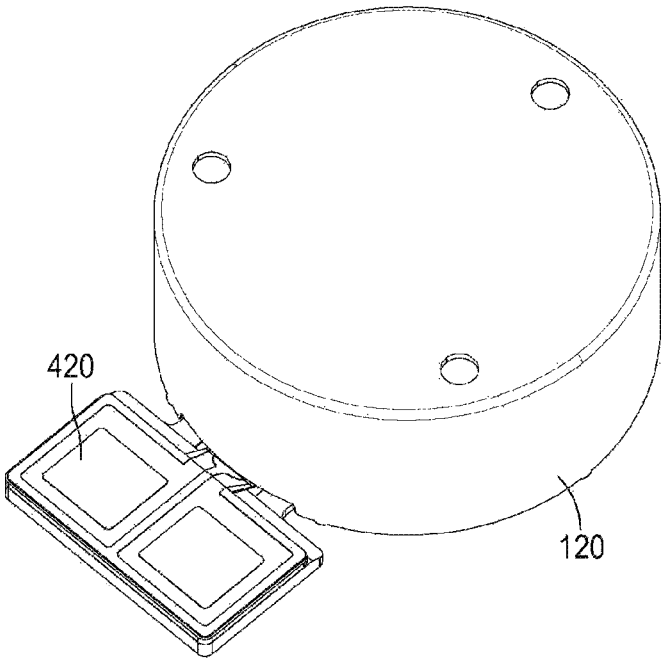
FIG. 7 is a perspective view showing the hybrid actuator according to the first embodiment of the present invention.

FIG. 7 is a perspective view showing the hybrid actuator according to the first embodiment of the present invention. The hybrid actuator according to the first embodiment of the present invention is equipped with two terminals 420, i.e., a pair of terminals 420. Therefore, a signal input to the coil 220 is the same as a signal input to the piezoelectric element 300.

Figure 8:
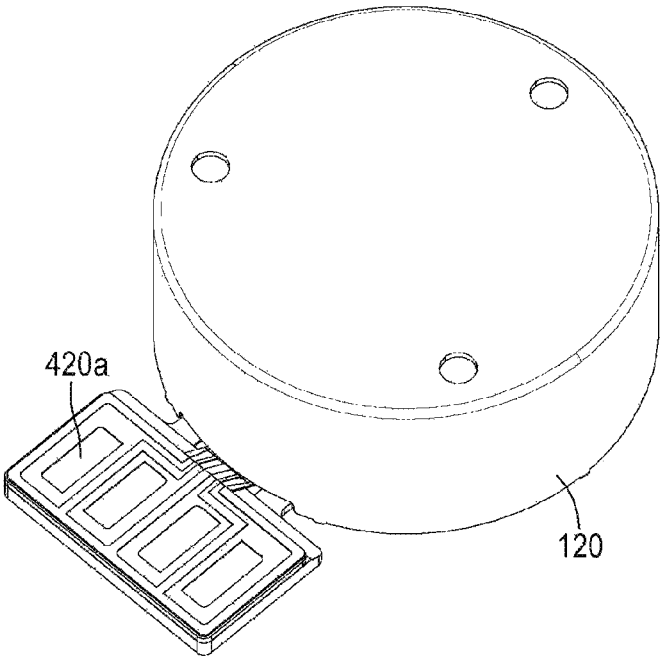
FIG. 8 is a perspective view showing the hybrid actuator according to the third embodiment of the present invention.

FIG. 8 is a perspective view showing the hybrid actuator according to the third embodiment of the present invention. The hybrid actuator according to the third embodiment of the present invention is equipped with four terminals 420, i.e., two pairs of terminals 420, such that a signal input to the coil 220 is transferred separately from a signal input to the piezoelectric element 300.

The hybrid actuator may be equipped with three or more terminals or three or more pairs of terminals as desired. That is, the hybrid actuator is equipped with two or more terminals, and the number of the terminals can be adjusted as desired.

Figure 9:
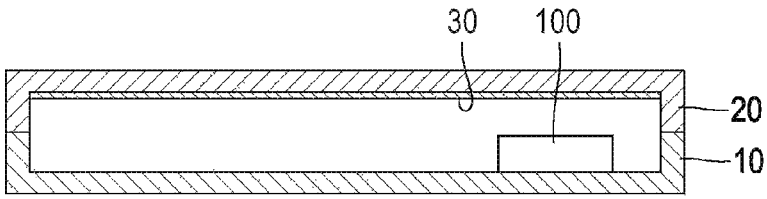
FIG. 9 is a schematic view showing a multimedia apparatus having a hybrid actuator according to one embodiment of the present invention.
Figure 10:
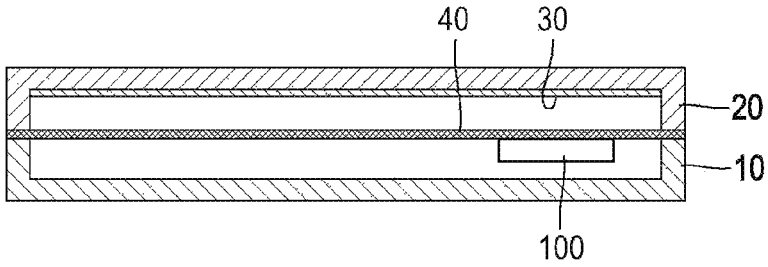
FIG. 10 is a schematic view showing a multimedia apparatus having a hybrid actuator according to another embodiment of the present invention.
Figure 11:
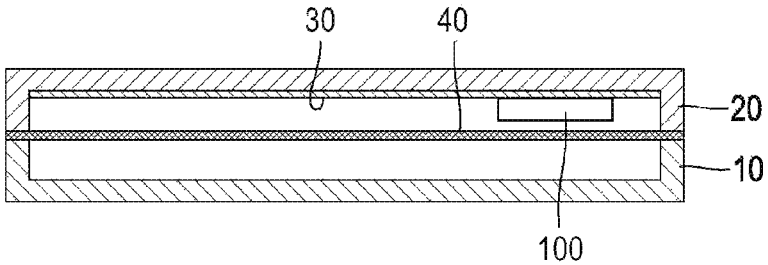
FIG. 11 is a schematic view showing a multimedia apparatus having a hybrid actuator according to a further embodiment of the present invention.

FIG. 9 is a schematic view showing a multimedia apparatus having a hybrid actuator according to one embodiment of the present invention, FIG. 10 is a schematic view showing a multimedia apparatus having a hybrid actuator according to another embodiment of the present invention, and FIG. 11 is a schematic view showing a multimedia apparatus having a hybrid actuator according to a further embodiment of the present invention. Here, the multimedia apparatus may be a small mobile apparatus that can be carried by a user or may be a large display device that can be installed in a house, such as a TV.

The multimedia apparatus having the hybrid actuator includes a case 10 for defining the external appearance of the apparatus, a display panel 30 for providing the user with visual effects, and a tempered glass 20 for protecting the display panel 30, and if need be, may further include an inner bracket 40 on which electronic components can be arranged.

The case 10 and the inner bracket 40, except the display panel 30 and the tempered glass 20, can be collectively referred to as a frame, and in some cases, the case 10 can be divided into a side case and a rear case.

The hybrid actuator 100 according to the present invention can be arranged on the frame 10 and 40 or the panel 30 to vibrate the whole multimedia apparatus as well as the surface on which it is arranged, which generates a sound or sensible vibration.

As discussed earlier, the portion corresponding to the structure of the linear actuator including the vibrator and the stator vibrates the multimedia apparatus at a frequency of 50 to 300 Hz to generate a sensible vibration and vibrates the multimedia apparatus at a frequency of 50 to 5000 Hz to generate a low-frequency sound, and the piezoelectric element vibrates the multimedia apparatus at a frequency of 300 to 20000 Hz to generate mid- and high-frequency sounds. As the linear actuator and the piezoelectric element are incorporated with each other, the linear actuator serves to generate a low-frequency sound and a sensible vibration and the piezoelectric element serves to generate mid- and high-frequency sounds, which makes it possible to overcome disadvantages of the conventional panel speaker using the piezoelectric element.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A hybrid actuator, comprising:

a housing for defining an external appearance;

a linear actuator including a stator and a vibrator arranged in the housing, the vibrator configured to vibrate due to a mutual electromagnetic force with the stator;

an elastic member configured to elastically support the vibrator relative to a first surface of the housing, wherein the linear actuator is configured to generate a vibration to the housing by the vibration of the vibrator; and a piezoelectric element attached to a second surface of the housing which faces the first surface of the housing and on which the elastic member is not arranged, wherein the hybrid actuator is coupled on a frame or a panel of a multimedia apparatus, and configured to vibrate the whole multimedia apparatus or a surface on which the hybrid actuator it is coupled, which generates a sound or a sensible vibration, wherein the vibrator of the linear actuator is configured to vibrate the multimedia apparatus at a frequency of 50 to 300 Hz to generate a sensible vibration signal, and vibrate the multimedia apparatus at a frequency of 50 to 5000 Hz to generate a low-frequency sound, wherein the piezoelectric element is configured to vibrate the multimedia apparatus at a frequency of 300 to 20000 Hz to generate mid- and high-frequency sounds.

2. The hybrid actuator of claim 1, wherein the piezoelectric element is arranged on an inner surface of the second surface of the housing.

3. The hybrid actuator of claim 1, wherein the piezoelectric element is arranged on an outer surface of the second surface of the housing.

4. The hybrid actuator of claim 1, further comprising two or more terminals configured to transfer a signal from the outside to the hybrid actuator.

5. A multimedia apparatus, comprising:

the hybrid actuator of claim 1;

a display panel; and a frame, wherein the hybrid actuator is coupled to the display panel or the frame to vibrate the whole multimedia apparatus to generate sound.

6. The multimedia apparatus of claim 5, wherein the hybrid actuator is configured such that the second surface of the housing to which the piezoelectric element is attached is brought into contact with the display panel or the frame.

7. The multimedia apparatus of claim 5, wherein the hybrid actuator is configured such that the first surface to of the housing and on which the piezoelectric element is not arranged is brought into contact with the display panel or the frame.

* * * * *